US006445349B1

(12) United States Patent
Jones

(10) Patent No.: US 6,445,349 B1
(45) Date of Patent: Sep. 3, 2002

(54) SATELLITE ANTENNA HEATING SYSTEM POWERED BY A STORAGE CAPACITOR

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

(21) Appl. No.: 09/633,557

(22) Filed: Aug. 7, 2000

Related U.S. Application Data

(63) Continuation-in-part of application No. 09/251,593, filed on Feb. 17, 1999, now Pat. No. 6,100,851.

(51) Int. Cl.[7] ..... H01Q 1/02
(52) U.S. Cl. ..... 343/704; 343/894
(58) Field of Search ..... 343/704, 894; H01Q 1/02

(56) References Cited

U.S. PATENT DOCUMENTS

| | | | | |
|---|---|---|---|---|
| 4,259,671 | A | 3/1981 | Levin | 343/704 |
| 5,694,138 | A | 12/1997 | Crosby | 343/704 |
| 5,729,238 | A | 3/1998 | Walton, Jr. | 343/704 |
| 5,796,368 | A | 8/1998 | Arthur | 343/704 |
| 5,798,735 | A | 8/1998 | Walton, Jr. | 343/704 |
| 5,861,855 | A | 1/1999 | Arsenault et al. | 343/704 |

*Primary Examiner*—Michael C. Wimer
(74) *Attorney, Agent, or Firm*—Taylor & Aust, P.C.

(57) ABSTRACT

A heated antenna system includes an antenna having a reflecting surface and a heater associated with the reflecting surface. A storage capacitor is connected with and provides power to the heater. An electronic control system is electrically connected to the storage capacitor. The electrical control system charges and monitors the storage capacitor and issues a status signal indicative of a status of the storage capacitor.

16 Claims, 5 Drawing Sheets

SATELLITE ANTENNA HEATING SYSTEM POWERED BY A STORAGE CAPACITOR

CROSS REFERENCE TO RELATED APPLICATIONS

This is a continuation-in-part of U.S. patent application Ser. No. 09/251,593, entitled "SATELLITE ANTENNA HEATING SYSTEM", filed Feb. 17, 1999 now U.S. Pat. No. 6,100,851.

BACKGROUND OF THE INVENTION

1. Field of the Invention

The present invention relates to reflectors in satellite systems, and, more particularly, heating systems for reflectors in satellite systems.

2. Description of the Related Art

An antenna reflector, commonly called a dish, is generally a parabolic section having a round, elliptical or other configuration. A reflector functions to gather radio or microwave frequency energy transmitted from the feed horn or through the ambient environment from an external transmitter. The reflector can thus be used to receive and transmit signals to and from the satellite system. Typical applications include communicating data collected by a point of sale terminal in a store to the central data processing location. In this way, a large company can keep track of its sales and inventory requirements on an instantaneous basis. Maintaining a reliable satellite contact is absolutely essential. Reflectors are usually located outdoors, where snow and ice may collect on the receiving or concave side, degrading the performance of the reflector. If the link fails, store clerks have no way of executing any transactions with a customer. Thus, outages caused by snow and ice accumulation on the antenna reflector and feed are intolerable. In view of this, it is known to install heating apparatuses for deicing antennas in climates where snow and ice can present problems.

Keeping these earth stations operating reliably during the winter months at locations exposed to snow requires deicing the antenna reflector and feed. Small antennas almost universally employ electric heaters for this purpose. To minimize energy consumption, the heaters are automatically controlled using a snow controller. A Model LCD-3S Snow Switch, manufactured by Environmental Technologies, Inc., is an example of a typical snow controller used for this purpose.

The antenna must have an unobstructed view of the desired satellite. Thus, an antenna for the satellite terminal is often installed on the roof of the structure. It is extremely expensive to wire power line voltage to the antenna for deicing purposes. In shopping complexes, the requirement for line voltage power at the antenna site may require that a conduit be run hundreds of feet to the customer's location. Such power line voltage must be carried in a conduit on the outside of the building, or fed through an opening in the roof, making the installation expensive. Also, such a rooftop location is not conveniently accessible.

Low voltage NEC Class 2 operation of the deicing heaters is one possible solution since no conduit is required. Unfortunately, this is not practical due to NEC power limitations. One hundred twenty-five watts is not enough power to deice other than the smallest antennas.

What is needed in the art is a heating system for a reflector which is internally powered, eliminating the need for power line voltage to be wired to the reflector.

SUMMARY OF THE INVENTION

The present invention provides a heating system for a satellite reflector including a storage capacitor which can be recharged with an electrical control system and power provided by a coaxial cable, which also carries data to the reflector.

In addition, the present invention provides remote control and monitoring of the deicing system. The point of remote control and monitoring can be either at the customer's location for maintenance purposes or at the hub earth station. A hub earth station communicates with each of the many small earth stations in a network. The small earth stations communicate with the hub station through the satellite. Thus, the small stations cannot communicate with one another. Hub stations technician monitor the deicing system and exercise control when the need arises.

The invention comprises, in one form thereof, a heated antenna system including an antenna having a reflecting surface and a heater associated with the reflecting surface. A storage capacitor is connected with and provides power to the heater. An electronic control system is electrically connected to the storage capacitor. The electrical control system charges and monitors the storage capacitor and issues a status signal indicative of a status of the storage capacitor.

An advantage of the present invention is that line voltage does not have to be wired, with an associated additional electrical conductor, from a power outlet located inside a building to a reflector located on a rooftop.

Another advantage is that if the heater is not functioning properly, an alarm signal is transmitted to a receiver at a location of the user's choice. Thus, the user is informed when maintenance and/or repair of the heating system is required.

Yet another advantage is that a low voltage NEC Class 2 power source can be used for deicing most small antennas.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
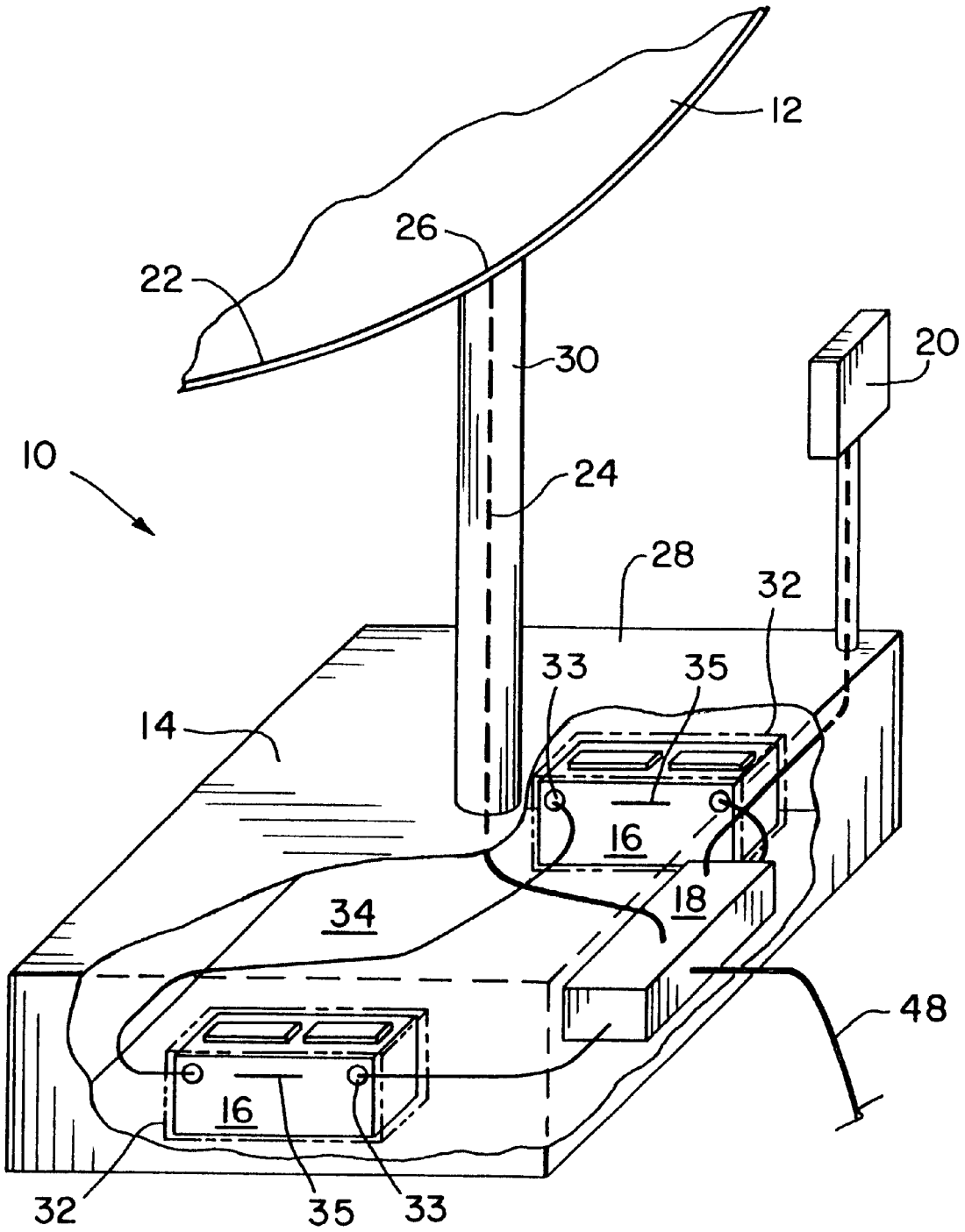
FIG. 1 is a simplified perspective view of one embodiment of a heated antenna system of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a heated antenna system 10 including a reflector 12, a container 14, batteries 16, electronics 18 and sensors 20.

Unless otherwise noted, details familiar to persons skilled in the electronic arts will be omitted since they are extraneous detail and thus have no bearing on reducing the invention to practice. Where in this application the terms "control", "controlling" or the like are used, it is to be understood that such terms may include the meaning of the terms "regulate", "regulating", etc. That is, such "control" may or may not include a feedback loop. Moreover, it is also to be understood, and it will be appreciated by those skilled in the art, that the methodology and logic of the present invention described herein may be carried out using any number of structural configurations such as electronic hardware, software, and/or firmware, or the like.

Reflector 12 includes a reflecting surface 22 having a desired curvature for the specific application for which reflector 12 is to be utilized. Reflecting surface 22 transmits radio or microwave frequency energy carried by a cable assembly 24. Reflecting surface 22 can also reflect such energy transmitted from an external source (not shown).

Reflector 12 also includes a heater 26 for melting accumulated ice and snow on reflecting surface 22. Heater 26, in the embodiment shown, is in the form of a zig-zagging resistance wire which is electrically connected to and powered by cable assembly 24. However, other types of heaters may be used. Cable assembly 24 includes a coaxial cable associated with a feedhorn (not shown), as well as at least one power line which carries current to heater 26.

Container or base 14 is shown in the form of a box which contains and somewhat loosely encloses batteries 16 and electronics 18. Alternatively, container 14 can be made substantially watertight so as to prevent outside moisture from damaging batteries 16 and electronics 18, and also to prevent any leakage from batteries 16 from coming in contact with the outside environment. Container 14 also carries sensors 20 on an outside surface 28. A pedestal 30 which supports reflector 12 is held upright in container 14 and extends therefrom, interconnecting container 14 and reflector 12. Container 14 holds pedestal 30 in position so that reflector 12 is maintained at a desired angle. Container 14, weighted down by batteries 16, also functions as a ballast for reflector 12.

Batteries 16 are in the form of two 12 volt direct current batteries that are series-connected to provide a maximum 24 volts to heater 26. Together, batteries 16 form a direct current voltage supply having a low voltage, herein meaning less than or equal to approximately 120 volts. Each 12 volt battery 16 includes a number of low voltage cells, each of which contributes perhaps 1.5 volts to the 12 volt total. Each 12 volt battery 16 is encased in a battery box 32 (shown in phantom lines to allow visualization of batteries 16) having a substantially leak-proof bottom which prevents any acid leakage from a battery 16 from entering into container 14. Battery box 32 is in the form of a substantially detachable shipping container or protection container. Battery box 32 includes terminals 33 which are electrically connected to the terminals (not shown) of battery 16. Terminals 33 allow batteries 16 to be wired without having to remove them from battery boxes 32. Battery box 32 includes vents 35 which allow the release of gasses, also known as outgassing, from battery 16. Batteries 16 are shown as being disposed on a bottom surface 34 of container 14, but may be placed at any desired location (e.g., under and attached to container 14). Batteries 16 have a weight which is sufficient to function as a ballast for reflector 12.

Figure 2:
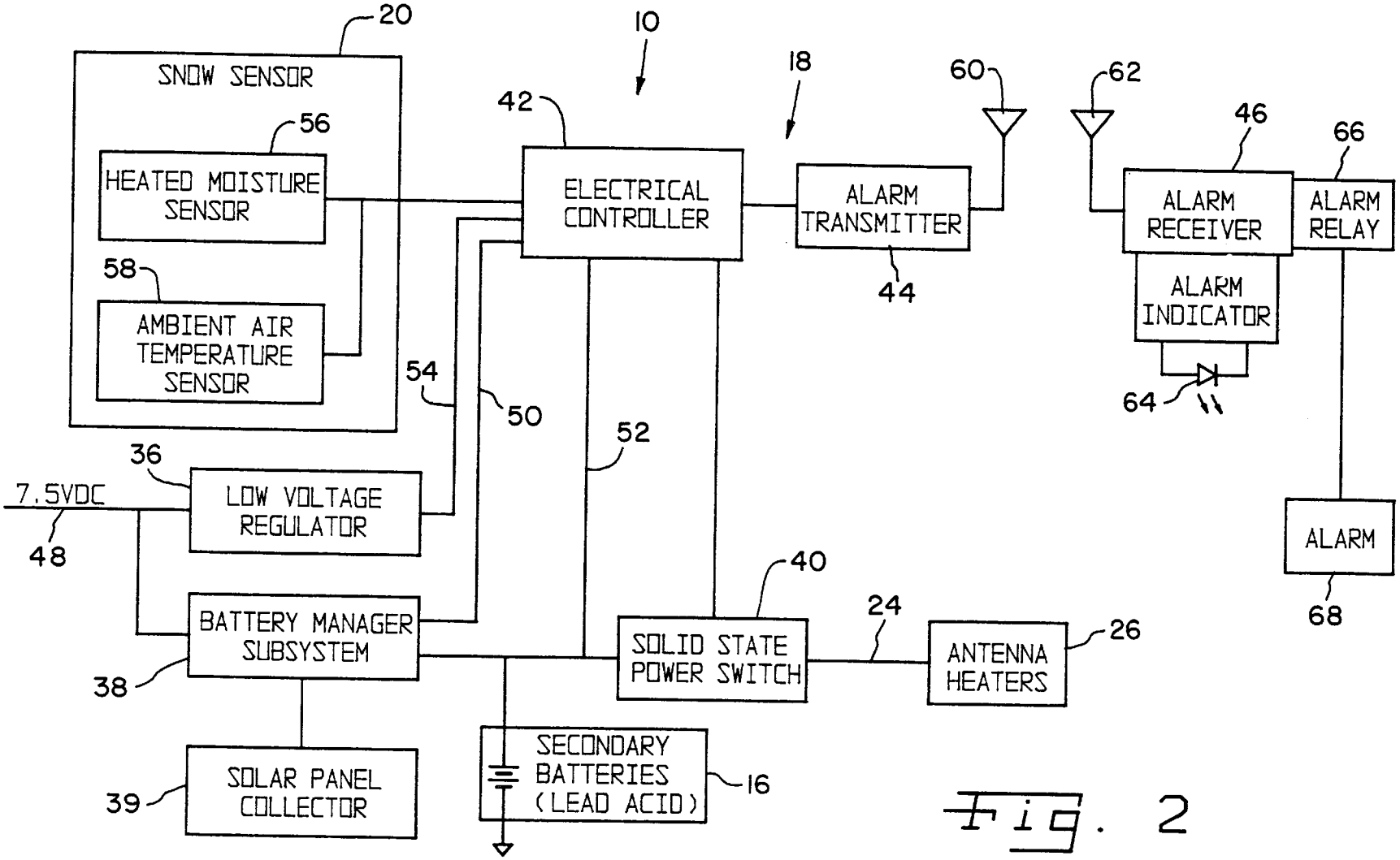
FIG. 2 is a schematic, block diagram of the heated antenna system of FIG. 1.

Referring now to FIG. 2, electronics 18 includes a low voltage regulator 36, a battery manager subsystem 38, a solar collector 39, a solid state power switch 40, an electrical controller 42 and an alarm transmitter 44. Battery manager subsystem 38 and electrical controller 42 together form an electrical control system, or monitoring device, which monitors the voltage of batteries 16 and recharges batteries 16 in order to maintain the voltage within a predetermined range.

Coaxial cable 48 carries both data and a relatively low direct current (DC) voltage offset, for example 7.5 volts, to electronics 18. The data is passed on, substantially unaltered, to reflector 12 by electronics 18. Electronics 18 uses the 7.5 volt direct-current offset to both power electronics 18 and to recharge batteries 16 through battery manager subsystem 38. Low voltage regulator 36 uses the DC voltage carried on coaxial cable 48 to provide a direct current power input, typically 5 volts, to electrical controller 42.

Battery manager subsystem 38 includes a DC-to-DC converter which steps up the 7.5 VDC offset carried on coaxial cable 48 to a desired DC voltage level, e.g., 24 volts DC, in order to recharge the two series-connected 12 volt batteries 16. In addition to charging batteries 16, battery manager subsystem 38 also monitors the present voltage level of batteries 16 in order to maintain the voltage within a predetermined range. It is well known that allowing the voltage of such lead-acid batteries to fall below a certain level, a condition also known as "deep discharge", can result in the failure of the battery. Destructive plating can occur as a result of the deep discharge, in which case the battery would have to be replaced. Conversely, overcharging lead-acid batteries can also result in damage to the batteries, as overcharging may lead to hot gassing in the form of a release of hydrogen gas.

Because of the criticality of maintaining batteries 16 within the predetermined voltage range, battery manager subsystem 38 recharges batteries 16 using a low current trickle charge. When the voltage of batteries 16 is below a certain threshold voltage, however, battery manager subsystem 38 is capable of recharging batteries 16 at a faster rate than that of the trickle charging mode. The threshold value may be above or below the lower limit of the predetermined voltage range in which batteries 16 are to be maintained. The voltage and the current of the trickle charge can be made dependent upon the ambient temperature, which temperature may be ascertained by sensors 20, as described in more detail hereinafter. It may be desirable to have a relatively high rate of charge at lower temperatures, where the heating needs of reflector 12 are greater, and consequently, so are the power needs.

In addition to recharging batteries 16, battery manager subsystem 38 also sends signals over line 50 to electrical controller 42. The signal indicates whether the present voltage level of batteries 16 is within the acceptable range.

Taking advantage of the rooftop location of reflector 12, a solar collector 39 can be connected to battery manager subsystem 38 in order to supplement the power supplied by the 7.5 volt DC input signal. Solar collector 39 reduces the power consumption and thus the overall cost of operating heated antenna system 10.

Electrical controller 42 is powered by the low voltage output of low voltage regulator 36 on line 54. The voltage of batteries 16 is also made available to electrical controller 42 over line 52 so that electrical controller 42 can use the battery voltage to power sensors 20. Electrical controller 42 can also be used to control the charging function of battery manager subsystem 38.

Sensors 20 are connected by a pole to outside surface 28 of container 14 such that a moisture sensor 56 can detect precipitation, such as rain or snow, and a temperature sensor 58 can measure the temperature of the outside environment. The height of the pole positions sensors 20 at a level where sensors 20 will not become buried by debris or previously fallen snow, and sensors 20 will not be warmed by the rooftop. Based upon information received from sensors 56 and 58, electrical controller 42 opens or closes solid state power switch 40, which electrically interconnects batteries 16 and heater 26. If moisture sensor 56 indicates that precipitation is present, and temperature sensor 58 indicates that the ambient air temperature is within a predetermined range, for instance, between 17° F. and 38° F., electrical controller 42 closes power switch 40. Current then flows from batteries 16 and through the resistance wire of heater 26, thereby heating heater 26 and reflector 12.

It is desirable for more power to be provided to heater 26 at the lower end of the predetermined temperature range, where more heat is required to melt the ice or snow on reflector 12, than at the upper end of the predetermined temperature range. Using the minimum amount of power necessary to melt the ice and snow prolongs the life of batteries 16 and thereby reduces the overall expense of operating heated antenna system 10. At ambient temperatures above 17° F., electrical controller 42 periodically opens and closes power switch 40 in order to reduce the time averaged voltage and current supplied by batteries 16 to heater 26. Thus, power switch 40 continually cycles between being opened and closed, with the percent of time power switch 40 is open increasing with temperature up to 38° F., whereat power switch 40 remains open. Thus, electrical controller 42 pulse width modulates the voltage and current supplied to heater 26 by batteries 16, thereby adjusting the average or effective voltage and current supplied.

In the event that batteries 16 cannot be maintained in the desired voltage range, perhaps because of the absence of the 7.5 volt DC input, the user is notified that the heated antenna system needs attention in the form of maintenance or repairs. Upon receiving a status signal from battery manager subsystem 38 on line 50 indicating that the 7.5 volt DC input voltage is present and batteries 16 are within the desired voltage range, electrical controller 42 periodically transmits a status signal to alarm transmitter 44. Upon receiving the status signal, alarm transmitter 44 transmits a corresponding status signal from antenna 60. The status signal, as transmitted from antenna 60, is airborne and can be, e.g., of radio frequency. The status signal from alarm transmitter 44 is received by the antenna 62 of an alarm receiver 46, which can be disposed at a location convenient to the user. Upon receiving the status signal, alarm receiver 46 resets an internal clock. If after a predetermined amount of time, for instance 30 minutes, alarm receiver 46 has not received another status signal indicating that the desired voltages are present, alarm receiver 46 activates a light emitting diode (LED) 64, which the user can see and thereby be informed that the heated antenna system needs attention. It is also possible for alarm receiver 46 to activate an alarm relay 66, which, in turn, activates an audio alarm 68 to be heard by the user.

Of course, the heated antenna system of the present invention can have embodiments other than as shown. For instance, container 14 can have virtually any geometric shape and may even be a plate carrying and/or resting upon batteries 16. Also, batteries 16 may be other than lead-acid, such as, for example, a gel battery. Gel batteries have the advantages that they do not typically leak and substantially no maintenance is required. Moreover, batteries 16 may provide a voltage above or below 24 volts.

In yet another embodiment (not shown), another DC-to-DC converter electrically interconnects solid state power switch 40 and heater 26. The DC-to-DC converter steps up the voltage of batteries 16 to approximately the same level as that of a standard power line voltage outlet, i.e., approximately 120 volts. The increased voltage allows a smaller current to be sourced into heater 26 while maintaining the same power level. The smaller current allows the use of a correspondingly smaller gauge wire to carry the current to heater 26 and a smaller gauge resistance heater wire within heater 26. Thus, the DC-to-DC converter allows the use of a conventional heater and conventional wiring in conjunction with a direct current battery power supply.

It is also possible to include a DC-to-AC converter between solid state power switch 40 and heater 26, with or without the above-described DC-to-DC converter. The DC-to-DC and DC-to-AC converters, and similar devices, can be used to convert the voltage of batteries 16 into substantially any waveform that suits the particular needs of the heater being used.

The present invention can also be implemented in a heater which heats something other than a reflector. For example, the present invention can also be used in conjunction with a sub-reflector heater or a feed horn heater.

Figure 3:
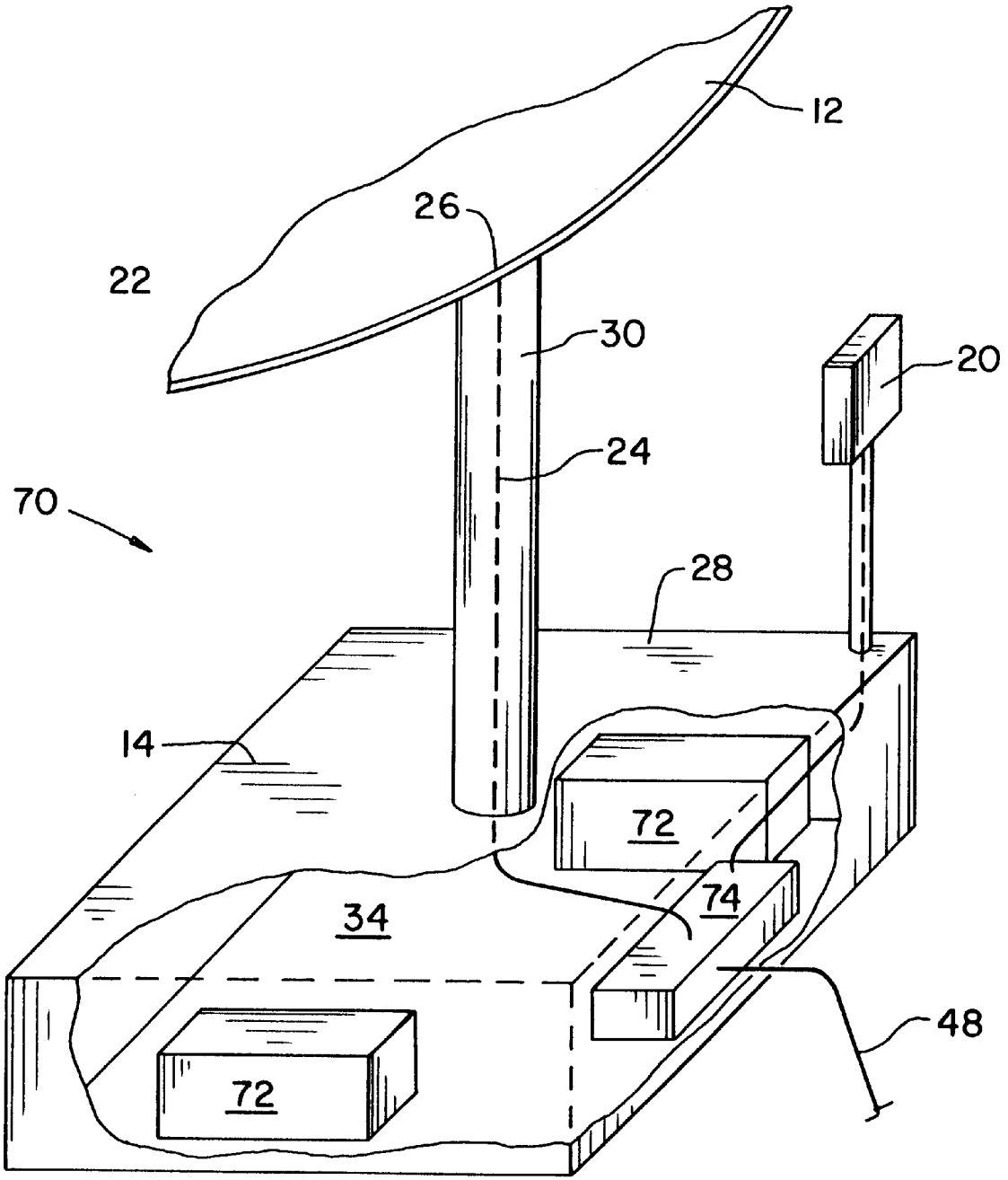
FIG. 3 is a simplified perspective view of another embodiment of a heated antenna system of the present invention.

In another embodiment of the present invention, shown in FIG. 3, a heated antenna system 70 includes ballasting blocks 72 in the place of batteries 16. Instead of using batteries to power heater 26, the electrical energy carried on coaxial cable 48 provides voltage and current to heater 26.

Figure 4:
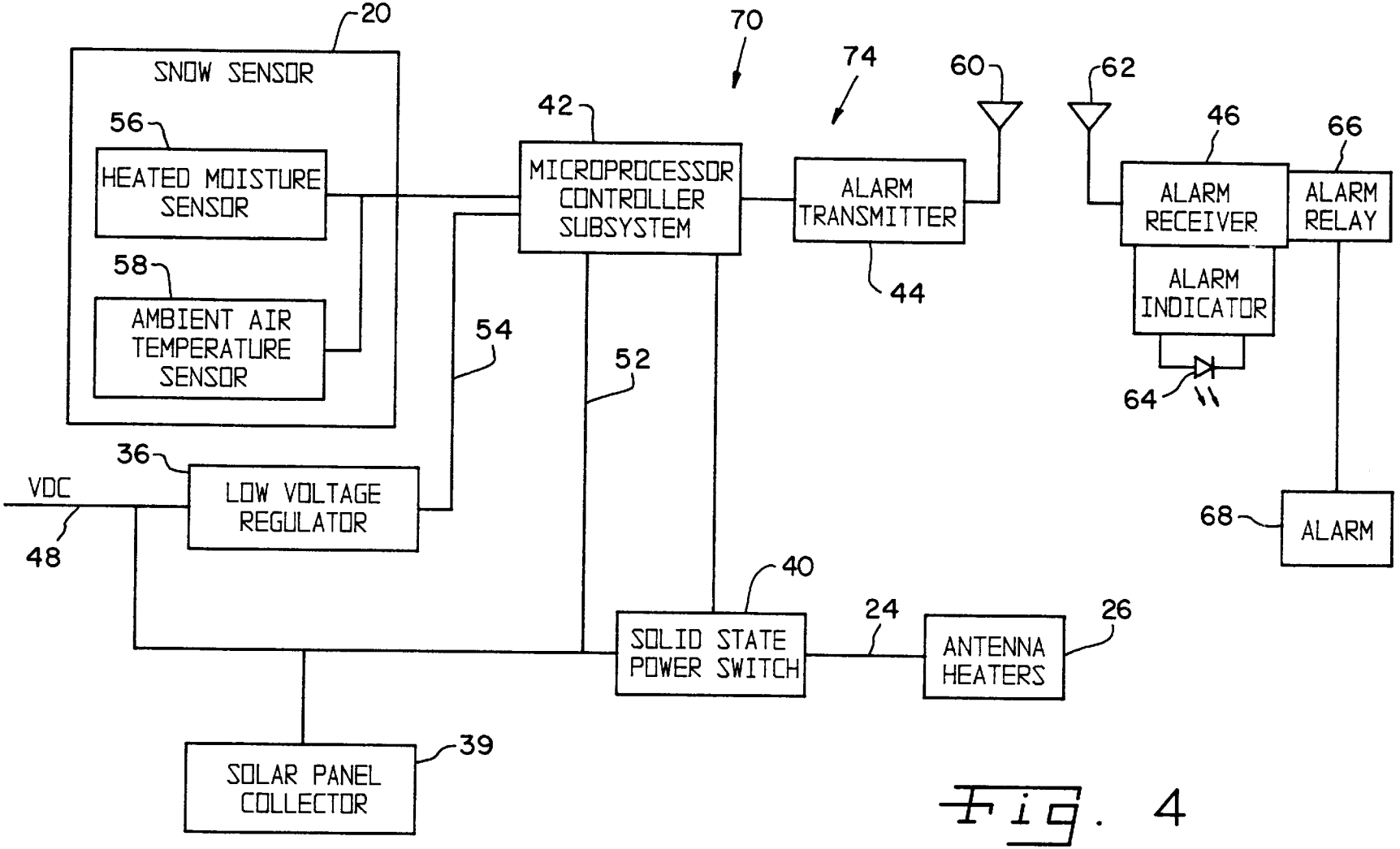
FIG. 4 is a schematic, block diagram of the heated antenna system of FIG. 3.

Referring now to FIG. 4, electronics 74 is substantially similar to electronics 18, except that battery manager subsystem 38 is eliminated. Coaxial cable 48 carries both data and a direct current (DC) voltage offset to electronics 74. The data is passed on, substantially unaltered, to reflector 12 by electronics 74. Electronics 74 uses the direct-current voltage offset to both power electronics 74 and to power heater 26.

The voltage level of the direct-current voltage offset can be set at substantially any level which meets the requirements of heater 26. For example, the direct-current voltage offset can be set approximately between 7.5 volts and 24 volts. Low voltage regulator 36 uses the DC voltage carried on coaxial cable 48 to provide a direct current power input, typically 5 volts, to electrical controller 42.

The higher the DC voltage offset, the smaller the current required to be sourced into heater 26 to maintain the same power level. The gauge of the wire in cable 48 carrying current to heater 26, and the gauge of the resistance heater wire within heater 26, can be selected based upon the power and current requirements of the particular application.

Figure 5:
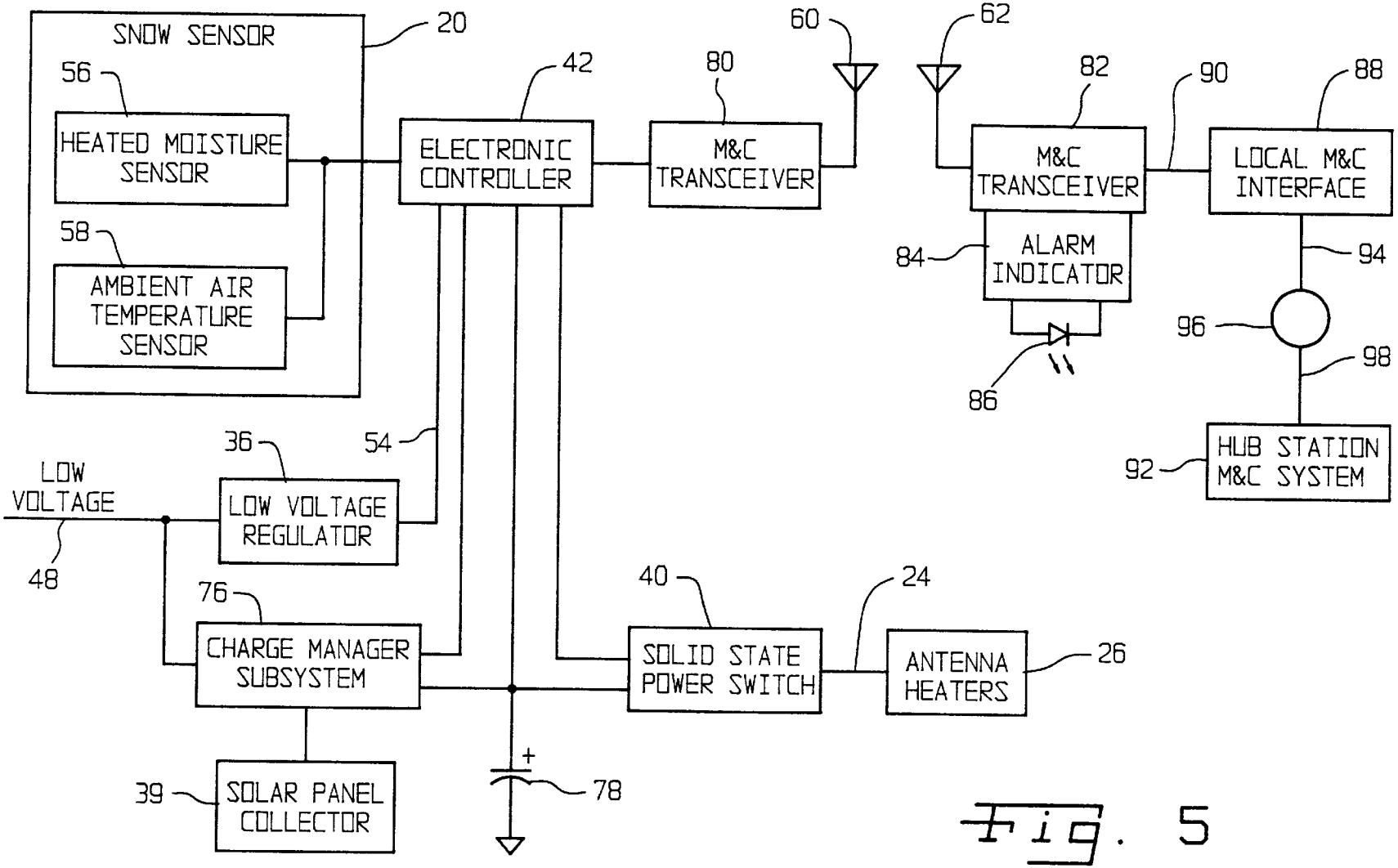
FIG. 5 is a schematic, block diagram of yet another embodiment of a heated antenna system of the present invention.

In another embodiment (FIG. 5), sensors 20 sense precipitation at temperatures below 3.3° C. Heating moisture sensor 56 melts frozen precipitation for easier detection. Moisture sensor 56 detects water by measuring the change of resistance of a sensing grid. Temperature sensor 58 employs a thermistor (not shown) as a temperature-sensitive resistive element. The moisture and temperature signals are applied to electronic controller 42 for further processing.

The low voltage at coaxial cable 48 for operating the system is applied to low voltage regulator 36 and to a charge manager subsystem 76. Depending upon the characteristics of external systems, the low voltage can range from 7.5 to 24 volts DC or 20 to 24 volts AC.

Low voltage regulator 36 processes the low voltage on line 48 so that it can supply the needs of electronic controller 42 and all other subsystems. Typically, the output voltage of low voltage regulator 36 is 5 volts DC.

Charge manager subsystem 76 takes power supplied from low voltage line 48 and solar panel collector 39 and, for maximum efficiency and minimal energy losses, converts it into a constant current for charging a storage capacitor 78. Charge manager subsystem 76 thus functions as a switching regulator. Electronic controller 42 monitors the voltage across capacitor 78. When this voltage reaches its maximum value, the maximum voltage rating of capacitor 78, electronic controller 42 inhibits the operation of charge manager subsystem 76.

The use of solar panel collector 39 is optional. Its high cost and interfacing complexity make this practical for only the most critical installations.

Capacitor 78 stores the energy for operating deicing heaters 26. A single capacitor 78 is shown for conceptual purposes. However, it is possible to provide several capacitors 78 in a parallel or series connection.

The charge stored in a capacitor is equal to one-half the square of the terminal voltage, and is expressed in coulombs. Charge can also be expressed in watt-seconds, which is a unit of energy. Thus, the energy stored in a capacitor 78 is the indefinite time integral of the charging power. Further, the power supplied to antenna heaters 26 is a mathematical derivative with respect to time of the watt-seconds of energy stored in capacitor 78. The greater the average power, the quicker that capacitor 78 becomes discharged. Capacitor 78 accumulates or stores the energy from the low voltage source on line 48 for use when required for deicing.

Electronic controller 42 monitors the terminal voltage of capacitor 78. When the voltage drops to 10% of its initial value, electronic controller 42 inhibits the operation of solid state power switch 40 since capacitor 78 is substantially discharged.

Solid state power switch 40 modulates the voltage applied to antenna heaters 26 on the basis of commands supplied by electronic controller 42. The voltage supplied to antenna heaters 26 is a constant frequency, variable duty cycle waveform. The waveform can have a frequency of between 1 Hz and 500 KHz, for example. The duty cycle can be varied from less than 10% to 100% depending upon the required heating power. Solid state switch 40 incorporates both over-temperature and over-current protection.

The duty cycle of the command signal supplied by electronic controller 42 varies with both ambient temperature and the voltage of capacitor 78. hi determining the duty cycle, electronic controller 42 first calculates the power of antenna heater 26 based on ambient temperature. If the ambient temperature is greater than 3.3° C. or less than −27° C., the duty cycle is zero percent. Inhibiting operation of antenna heater 26 below −27° C. prevents wasting energy at temperatures too low for effective deicing. The duty cycle increases from zero percent at 3.3° C. to one hundred percent at −27° C. In between these temperature limits, electronic controller 42 increases duty cycle so as to provide a linear increase in power. The linear power relationship has a negative slope with regard to temperature. Electronic controller 42 continues operation of antenna heater 26 for an hour after the snow stops to insure complete melting.

Next, electronic controller 42 corrects the duty cycle for variations in the voltage of capacitor 78. The higher the voltage, the lower the duty cycle. In effect, the resultant duty cycle is the product of temperature compensated and voltage compensated duty cycles.

Antenna heaters 26 include both reflector and feed heaters. Depending upon design preferences, they can be either series or parallel connected.

Electronic controller 42 monitors all the functions that it observes and controls. Thereafter, controller 42 communicates this information to a monitor and control transceiver 80. Monitor and control transceiver 80 transmits this information from antenna 60 to antenna 62 and then to monitor and control transceiver 82. If a fault condition exists, monitor and control transceiver 82 communicates this information to local alarm indicator 84. In turn, alarm indicator 84 operates its light emitting diode 86 to warn operating personnel that a problem exists.

Electronic controller 42 passes complete status information to a local monitor and control interface 88 via an RS232C connection 90 using an asynchronous serial protocol. Local monitor and control interface 88 encodes the status information so that it can be connected to the external communication via the input/output connection and then to a hub station 92. More particularly, the information is transmitted via the connection to local station transceiver 82, to a link 94 and thence via an uplink/downlink to a satellite 96 and on to a link 98 connected to hub station monitor and control system 92. Operating personnel can view the status of the remote station and take appropriate action if and when a problem is detected.

Operating system personnel can assert control over the various functions of the remote deicing system. They gain access to the remote system through hub station monitor and control system 92 and thence through connection 98 to the uplink/downlink to satellite 96. The downlink signal connects with the local monitor and control interface 88 and thence to monitor and control transceiver 82 and thence to its antenna 62. Monitor and control transceiver 80 receivers the signal with its antenna 60. Thereafter, monitor and control transceiver 80 decodes the remote command signals for application to electronic controller 42. Electronic controller 42 executes the remote commands and updates the status which is thence returned to operating personnel at the hub earth station.

Typical status information includes the ambient temperature, the presence of precipitation, the percent of maximum energy stored in capacitor 78, the charging current available, a failure of the heated moisture sensor 56, failure of the ambient air temperature sensor 58, operation of antenna heaters 26, operation of a hold-on timer for antenna heaters 26, power failure, and failure of antenna heaters 26.

Typical commands to be given by operating personnel are to operate heaters 26 independent of ambient air temperature and the presence of precipitation, turn heaters 26 off independent of ambient conditions, control antenna heaters 26 thermostatically, and revert to local automatic control. In thermostatic control, heaters 26 are operated when the ambient temperature is below a predetermined level, and are not operated when the ambient temperature is not below the predetermined level.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heated antenna system, comprising:

an antenna having a reflecting surface and a heater associated with said reflecting surface;

a storage capacitor connected with said heater, said storage capacitor being configured for providing power to said heater; and an electronic control system electrically connected to said storage capacitor, said electrical control system being configured for charging and monitoring said storage capacitor and issuing a status signal indicative of a status of said storage capacitor.

2. The system of claim 1, further comprising an alarm device configured for activating an alarm dependent upon said status signal.

3. The system of claim 1, wherein said electronic control system includes a source of constant current for charging said storage capacitor.

4. The system of claim 3, wherein said source of constant current is configured both for being powered by an alternating current voltage source and for being powered by a direct current voltage source.

5. The system of claim 4, further comprising a solar collector connected to said source of constant current, said solar collector being configured for powering said source of constant current.

6. The system of claim 1, wherein a charge stored in said storage capacitor is proportional to a square of a terminal voltage of said storage capacitor.

7. A heated antenna system, comprising:

an antenna having a reflecting surface and a heater associated with said reflecting surface;

a storage capacitor connected with said heater, said storage capacitor being configured for providing power to said heater;

an electronic control system electrically connected to said storage capacitor, said electrical control system being configured for charging and monitoring said storage capacitor and issuing a status signal indicative of a status of said storage capacitor; and a power switch electrically interconnecting said storage capacitor and said heater, said electrical control system being electrically connected to said power switch, said electrical control , system being configured to open and close said power switch such that said power switch transmits a pulse width modulated voltage to said heater, a level of said pulse width modulated voltage being dependent upon an ambient temperature.

8. A heated antenna system, comprising:

an antenna having a reflecting surface and a heater associated with said reflecting surface;

a direct current voltage supply connected with said heater, said direct current voltage supply being configured for providing power to said heater;

an electronic control system electrically connected to said direct current voltage supply, said electrical control system being configured for charging and monitoring said direct current voltage supply and issuing a status signal indicative of a status of said direct current voltage supply; and a bi-directional radio frequency communication system configured for providing bi10 directional radio frequency radio communication between said electronic control system and a remote monitoring station.

9. The system of claim 8, wherein said communication system carries said status signal to said remote monitoring station.

10. The system of claim 9, wherein said communication system carries at least one command from said remote monitoring station to said electronic control system.

11. The system of claim 10, wherein said at least one command comprises at least one of a command to turn on said heater and a command to turn off said heater.

12. A heated antenna system, comprising:

an antenna having a reflecting surface and a heater associated with said reflecting surface;

a direct current voltage supply connected with said heater, said direct current voltage supply being configured for providing direct current power to said heater; and a monitoring device electrically connected to said direct current voltage supply, said monitoring device being configured for monitoring said direct current voltage supply and transmitting an airborne status signal indicative of a status of said direct current voltage supply.

13. The system of claim 12, further comprising an alarm receiver configured for receiving said airborne signal and activating an alarm dependent upon said airborne signal.

14. The system of claim 12, wherein said direct current voltage supply comprises a storage capacitor.

15. The system of claim 12, wherein said airborne status signal comprises a radio frequency status signal.

16. The system of claim 12, wherein said status of said direct current voltage supply comprises a voltage level.

* * * * *

UNITED STATES PATENT AND TRADEMARK OFFICE

CERTIFICATE OF CORRECTION

PATENT NO. : 6,445,349 B1
DATED : September 3, 2002
INVENTOR(S) : Jones

It is certified that error appears in the above-identified patent and that said Letters Patent is hereby corrected as shown below:

Column 7,
Line 45, delete “hi” and substitute -- In -- therefor.

Column 10,
Line 11, delete “bil0 directional” and substitute -- bidirectional -- therefor.

Signed and Sealed this

Seventeenth Day of June, 2003

JAMES E. ROGAN
*Director of the United States Patent and Trademark Office*